US009079644B2

(12) United States Patent
Aarsnes et al.

(10) Patent No.: US 9,079,644 B2
(45) Date of Patent: Jul. 14, 2015

(54) PRODUCTION UNIT HAVING A BALLASTABLE ROTATION SYMMETRIC HULL AND A MOONPOOL

(75) Inventors: Jan Vidar Aarsnes, His (NO); Otto Skjåstad, Kolbjørnsvik (NO); Kåre Syvertsen, Tveit (NO)

(73) Assignee: Sevan Marine ASA, Arendal (NO)

( * ) Notice: Subject to any disclaimer, the term of this patent is extended or adjusted under 35 U.S.C. 154(b) by 96 days.

(21) Appl. No.: 13/982,740

(22) PCT Filed: Jan. 31, 2012

(86) PCT No.: PCT/EP2012/051579

§ 371 (c)(1),
(2), (4) Date: Oct. 8, 2013

(87) PCT Pub. No.: WO2012/104308

PCT Pub. Date: Aug. 9, 2012

(65) Prior Publication Data

US 2014/0020615 A1 Jan. 23, 2014

(30) Foreign Application Priority Data

Feb. 1, 2011 (NO) ..... 20110174

(51) Int. Cl.
*B63B 35/44* (2006.01)
*B63B 39/00* (2006.01)

(52) U.S. Cl.
CPC ..... *B63B 35/4413* (2013.01); *B63B 39/00* (2013.01)

(58) Field of Classification Search
CPC ..... B63B 35/44; B63B 35/4413; B63B 39/00
USPC ..... 114/264, 265; 405/195.1, 203, 223.1, 405/224.2, 224.4
See application file for complete search history.

(56) References Cited

U.S. PATENT DOCUMENTS 4,185,694 A 1/1980 Horton
4,646,672 A 3/1987 Bennett et al.
(Continued)

FOREIGN PATENT DOCUMENTS

JP 6-56074 A 3/1994
NO 319971 B1 10/2005
(Continued)

OTHER PUBLICATIONS

International Search Report and Written Opinion received for PCT Patent Application No. PCT/EP2012/051579, mailed on May 3, 2012, 10 pages.
(Continued)

*Primary Examiner* — Lars A Olson
(74) *Attorney, Agent, or Firm* — Morrison & Foerster LLP

(57) ABSTRACT

A floating production unit is operable for production and storage of hydrocarbons. The production unit exhibits in operation movement properties rendering connection of one or more loose hanging risers (5) of suitable material possible. Such a unit comprises a hull (1) and a deck (4) in an upper end of the hull, the deck being equipped adequately in accordance with the intended application. The floating production unit is distinguished in that the hull (1) is configured to allow suspension of the riser (5) on at least one frame (6) arranged in a shaft/moonpool (3) in a center of the hull (1) wherein vertical movements of the hull (1) are minimized, and that the moonpool (3) of the unit surrounds and protects an upper part of the one or more risers (5) and fixed tubes for transfer of fluid to a processing facility of the production unit against external forces such as waves, ice and vessel collisions, in addition to corresponding protection during connection of the one or more risers (5) unto the at least one frame (6).

12 Claims, 1 Drawing Sheet

(56) References Cited

U.S. PATENT DOCUMENTS

| | | | |
|---|---|---|---|
| 5,330,293 | A | 7/1994 | White et al. |
| 2004/0067109 | A1 | 4/2004 | Pollack et al. |
| 2009/0126616 | A1 | 5/2009 | Srinivasan |

FOREIGN PATENT DOCUMENTS

| | | | |
|---|---|---|---|
| WO | 02/090177 | A1 | 11/2002 |
| WO | 02/092425 | A1 | 11/2002 |
| WO | 2009/136799 | A1 | 11/2009 |

OTHER PUBLICATIONS

International Preliminary Report on Patentability received for PCT Patent Application No. PCT/EP2012/051579, mailed on Aug. 15, 2013, 8 pages.

Norwegian Search Report received for Norwegian Patent Application No. 20110174, mailed on Aug. 31, 2011, 1 page.

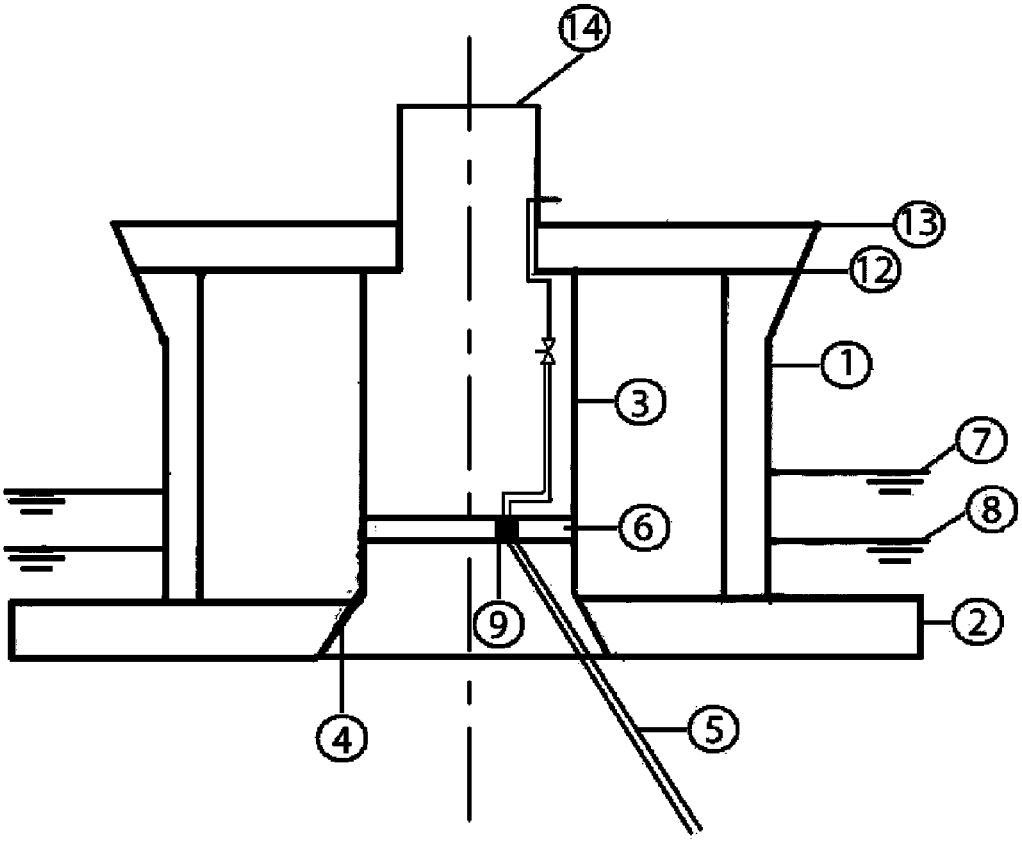
14
13
12
1
3
7
8
6
9
2
4
5

PRODUCTION UNIT HAVING A BALLASTABLE ROTATION SYMMETRIC HULL AND A MOONPOOL

CROSS REFERENCE TO RELATED APPLICATIONS

This application is a U.S. National Phase patent application of PCT/EP2012/051579, filed on Jan. 31, 2012, which claims priority to Norwegian Patent Application No. 20110174, filed on Feb. 1, 2011, each of which is hereby incorporated by reference in the present disclosure in its entirety.

TECHNICAL FIELD

Background and Prior Art

For hydrocarbon drilling, and production and storage of produced hydrocarbons at sea, numerous concepts exist. Nowadays, floating production units, for example units based on ship hulls or semi-submersible platforms, are chosen for numerous offshore developments.

For a floating production unit, it is common to connect wells to the production unit by use of a pipeline on the seabed and flexible risers from the seabed and up to the production unit. An alternative is to use flexible risers from a top of freestanding vertical "rigid" risers, wherein the risers are kept up by a buoyancy element, namely a hybrid riser arrangement. Flexible risers are used on account of their ability to counteract relative movements between the production unit and a corresponding connection point, which could be on the seabed or, for the hybrid solution, at the top of the rigid riser.

In deep sea situations, it is more complicated and costly to use flexible risers from the seabed since different associated devices such as buoyancy elements must be just to assure that the flexible risers manage to carry their own weight. Use of loose hanging risers of steel (SCR) in deep sea situations, i.e. all-welded tubes of steel or other suitable materials such as for example titanium, will reduce the complexity and cost significantly, since such risers may carry their own weight and may be arranged in a catenary configuration.

To be able to use rigid risers, it is feasible to achieve an acceptable relative movement between the floating production unit and the fixed connection point on the seabed.

There exist different floating production units achieving an acceptable relative movement. However, all of them have some form of limitation such as load capacity for tools, suspension point for the risers, connection of the risers, use of turret/revolving cylinder, protection of the risers in the wave zone, installation of the unit, pre-installation of risers on the seabed, storage capacity for produced oil, produced water, produced condensate, and security during leakage from the connection point of the risers. From the known publically available art, reference is primarily made to a granted Norwegian patent NO 319971 disclosing an offshore platform of cylindrical type, mainly flat bottomed, in which a diameter of the cylinder diameter is significantly larger than a depth of the platform. A centre of buoyancy of a submersed part of the platform is positioned underneath a centre of gravity of the platform. Such a construction has shown to be advantageous in many ways, for example by providing large capacity both for the loading on deck and storage of oil. The form of the platform causes the act of turning depending on weather and wind conditions redundant, and its movement and strains are small compared to other types of floating installations.

A further development of this platform is disclosed in patent application WO2009136799A1 that is particularly suitable for use in regions of water susceptible to being exposed to ice. The hull/body of the platform is divided into sections of which the hull diameter in the downward direction decreases, remains constant and increases, respectively. In addition, the platform may have a coupling part having its on buoyancy for connecting/guiding lines, risers and similar parts.

For use of risers of steel arranged in catenary formation, it is important that the platform has movement characteristics that are adjusted to the risers. This adjustment is achieved by a correct hull design and optimizing a lip arrangement ("bilge box") localized in the lower part of the hull. This lip arrangement is formed as an annular construction having a larger diameter then the main hull.

OBJECT OF THE INVENTION

It is an object of the present invention to provide a production unit that is constructed for application of loose hanging risers of suitable material such as steel or Titanium. The invention is intended to be used in deep waters and in sea areas with harsh weather conditions.

Suitable material is herewith defined as material(s) having material properties causing a riser produced with such material(s) to be able to carry its own weight, and is configurable in a catenary formation.

SUMMARY OF THE INVENTION

In accordance with the present invention, the above-mentioned objects are achieved by a production unit as defined in claim 1 having the characterizing features defined in the characterizing part of the claim. Further preferred embodiments of the invention are disclosed in the dependent claims 2 to 11.

More specifically, the invention comprises a floating production unit/platform for production and storage of hydrocarbons, in particular at deep sea, wherein the inventive production unit has movement properties rendering connection of one or more loose hanging/suspending risers of suitable material such as steel possible. The unit comprises a hull and a deck in an upper end of the hull, the deck being equipped adequately in accordance with the intended application. Furthermore, the present invention is characterized in that the hull is configured to allow suspension of the riser, for example fabricated from steel (SCR), on at least one frame arranged in a shaft/moonpool in a center of the hull, namely where the vertical movements of the hull are most favorable. The moonpool is further configured so that it surrounds and protects the upper part of the one or more risers and fixed tubes for transfer of fluid to the processing facility against external forces such as waves, ice and vessel collisions, in addition to corresponding protection during connection of the one or more risers unto the at least one frame.

Deep water is hereinafter defined as water having a depth of 4500 meters or more.

Furthermore, it is considered as advantageous that the inventive unit can be ballasted so that the vertical position of the at least one frame is adjusted to a position located above the waterline during installation of the one or more risers.

Additional advantages with the present invention are achieved by the at least one frame being positioned below the waterline when the unit is in service since such a position results in a more damped water movement inside the moonpool, or that the at least one frame is positioned below the waterline when the unit is in service with the purpose of preventing an occurrence of a leakage in one or more of the risers causing unintentional incidents such as explosions and/or fire, which again may influence one or more of the other installed risers.

In a preferred embodiment of the present invention, the moonpool has an extent above the deck to reduce an effect of one or more unintentional incidents in the moonpool such as explosion and/or fire. The extent of the moonpool is, in other words, advantageous since it contributes in the effort of avoiding that one or more incidents inside the moonpool area influences the areas on the main deck or in the process area.

In another preferred embodiment of the present invention, the moonpool has a conical form at its lower end, thereby allowing static and dynamic angular deflections of the risers.

In another preferred embodiment of the present invention, the hull is equipped with a protrusion or a lip which reduces stamping and rolling movements after the hull being submersed.

In another preferred embodiment of the present invention, the form of the hull is circular, or substantially circular and/or the outer sidewall of the hull has primarily rotational symmetry around a vertical center axis of the unit.

In another preferred embodiment of the present invention, the draft (t) of the unit is significantly smaller than the diameter (D) of the unit. For example, the ratio between T and D may be less than 0.5, more preferably less than 0.4.

The buoyancy center of the submersed part of the inventive unit is preferably positioned lower than the centre of gravity of the unit.

The mainly rotationally symmetric outer side of the hull of the present invention may preferably include at least three sections calculated/measured from the upper end of the hull:

an upper section having a decreasing diameter in the direction downwards along the center axis, an intermediate section having cylindrical form or close to cylindrical form, and a lower section having cylindrical form or close to cylindrical form and a diameter greater than the intermediate section.

Finally, it is preferred that the inventive production unit is configured/equipped so that it is kept submersed in a geostationary manner despite of external forces from, for example, weather and wind conditions. Such a geostationary position renders installation of several risers possible.

The loose hanging risers will be pulled in operation towards the center of the platform/unit in the moonpool arrangement. Inside the moonpool, suspension frames are arranged in which risers are fastened which are further connected to tubular systems in the production unit/platform. The suspension frame(s) is/are placed so that connection of the risers may be performed above the water (dry connection) when the platform has its minimum draft. The arrangement of risers in a central moonpool provides reduced wave movements on the risers, in addition of giving protection against any ice- or vessel collisions.

As aforementioned, the moonpool is localized in the center of the hull. In this position, the vertical movements are at a minimum mainly due to small/minimal contributions from rolling and stamping movements.

The inventive production unit may be completed at yards and may be hauled out and installed in the oil/gas field ready for operation, resulting in significant cost and time savings.

SHORT SUMMARY OF THE DRAWINGS

The production unit in accordance with the present invention will be further described in the following using some exemplary embodiments and by reference to the drawing, wherein FIG. 1 is an illustration of a cross section of the inventive production unit.

DETAILED DESCRIPTION OF EMBODIMENTS OF THE INVENTION

In an embodiment of the present invention, the production platform or unit comprises a cylindrical hull 1 with an approximately circular external form set by the sidewall(s) of the hull 1. The notion 'approximately circular' includes in this case also polygon designs, such as when the sidewalls are assembled or formed from a large number of joined plane elements or surfaces all around a perimeter of the hull 1. The hull 1 includes underneath or below a heavily outward protruding platform disc 2, often called lip or "bilge box", and this platform disc 2 contributes to a significant reduction in movements of the platform when the platform is exposed for external forces such as waves. A vertical opening, hereinafter referred to as "moonpool 3", is located in the center of the hull 1, in which there is arranged a frame 6 in the lower part for suspension of risers 5, preferably fabricated from steel (SCR). The frame 6 is, during normal operational draft, submersed. However, the draft of the platform is reduced during connection of the risers 5 so that the suspension frame 6 is located above the waterline. The loose hanging risers 5, for example fabricated from steel (SCR), are suspended in the frame 6 at a flexible connection device 9. The flexible connection device 9 can, for example, be either a flex joint or a flexible upper part of the riser 5 of suitable material such as Titanium or high strength steel. Fixed tubes, for example fabricated from steel, are connected to the risers 5 from where the flexible connection device 9 is fastened to the suspension frame 6, and are further connected to process tools of the platform on the process deck 13. The loose hanging risers 5, for example fabricated from steel (SCR), extend from the suspension in the moonpool 3 to the seabed in a catenary formation.

In the illustrated embodiment, the moonpool 3 has a cylindrical form that in its lower part may be given an outward directed conical form 4 to achieve a distance between the riser 5 and the hull 1 in case the risers 5 and the hull 1 are moving. To avoid an incident in the moonpool area influencing the area on the main deck 12 or the process deck 13, the moonpool 3 has an extent to above the process deck 13. Above the main deck 12, the extended vertical moonpool 3 is narrowed down for increasing a space available for accommodating tools on the main deck 12 and on the above positioned process deck 13. At the top of the platform, within the extension of the moonpool 3, as shown in FIG. 1, there are optionally mounted explosion panels 14 for weather protection.

To reduce the water movements inside the moonpool 3, the frame 6 is, in the position in which the risers 5 are suspended, given a horizontal area sufficient to slow down inflow and outflow of water.

The invention claimed is:

1. A floating production unit for production and storage of hydrocarbons, wherein said production unit has movement properties rendering connection of one or more loose hanging risers, wherein the unit comprises:

a hull, and a deck at an upper end of the hull, the deck being equipped with at least one process tool in accordance with an intended application of said platform, wherein the hull is configured to allow suspension of said one or more risers from at least one frame arranged in a moonpool at a center of the hull wherein vertical movements of the hull are minimized in operation, the moonpool of the unit surrounds and protects an upper part of the one or more risers and fixed tubes for transfer of fluid to a processing facility of the unit against external forces, in addition to corresponding protection during connection of the one or more risers unto the at least one frame, the one or more risers are suspended at a flexible connection device fastened to the frame, the fixed tubes are connected to the risers at the flexible connection device and to the at least one process tool, and the moonpool extends above the deck to reduce an effect of one or more unintentional incidents in the moonpool.

2. A floating production unit in accordance with claim 1, characterized in that the unit can be ballasted so that the vertical position of the at least one frame acquires a position located above a waterline during installation of the one or more risers.

3. A floating production unit in accordance with claim 1, characterized in that the at least one frame is positioned below a waterline when the unit is in service, with a purpose of damping water movements in the moonpool.

4. A floating production unit in accordance with claim 1, characterized in that the at least one frame is positioned below a waterline when the unit is in service, with a purpose of preventing a leakage in one or more of said one or more risers from creating unintentional incidents, which again may influence one or more of the other installed risers.

5. A floating production unit in accordance with claim 1, characterized in that the moonpool has a conical form at a lower end of the moonpool, thereby allowing static and dynamic angular deflections of the one or more risers.

6. A floating production unit in accordance with claim 1, characterized in that the hull is equipped with a lip for reducing stamping and rolling movements when said production unit is in operation.

7. A floating production unit in accordance with claim 1, characterized in that the unit is operable to maintain geostationary position when in operation.

8. A floating production unit in accordance with claim 1, characterized in that the hull has an outer form which is circular or substantially circular.

9. A floating production unit in accordance with claim 1, characterized in that an outer sidewall of the hull has primarily rotation symmetry around a vertical center axis of the unit.

10. A floating production unit in accordance with claim 1, characterized in that a ratio between a draft of the unit and a diameter of the unit is less than 0.5.

11. A floating production unit in accordance with claim 1, characterized in that a buoyancy center of a submersed part of the unit is positioned lower than a centre of gravity of the unit.

12. A floating production unit in accordance with claim 9, characterized in that the mainly rotation symmetric outer side of the hull includes at least three sections calculated/measured from an upper end of the hull:

an upper section having a decreasing diameter in a direction downwards along a central axis of the hull, an intermediate section having a cylindrical form or close to a cylindrical form, and a lower section having a cylindrical form or close to a cylindrical form and a diameter greater than the intermediate section.

* * * * *